US009483925B1

(12) United States Patent
Greenstein et al.

(10) Patent No.: US 9,483,925 B1
(45) Date of Patent: Nov. 1, 2016

(54) AUTOMATIC SYSTEM AND METHOD FOR DETECTING PRESENCE OF PEOPLE OR ANIMALS IN A VEHICLE

(71) Applicant: CAREMOTION 40 LTD, Moshav Bat Slomo (IL)

(72) Inventors: Boris Greenstein, Lod (IL); Gadi Shvets, Moshav Bat Slomo (IL); David Spectorman, Moshav Mazlih (IL)

(73) Assignee: CAREMOTION 40 LTD, Moshav Bat Slomo (IL)

( * ) Notice: Subject to any disclaimer, the term of this patent is extended or adjusted under 35 U.S.C. 154(b) by 0 days.

(21) Appl. No.: 14/975,795

(22) Filed: Dec. 20, 2015

(51) Int. Cl.
*G08B 21/02* (2006.01)

(52) U.S. Cl.
CPC ..... *G08B 21/0272* (2013.01)

(58) Field of Classification Search
CPC ..... G02B 21/0236; G02B 21/0272; G02B 21/0438; G02B 21/0461; G02B 21/22
See application file for complete search history.

(56) References Cited

U.S. PATENT DOCUMENTS

2015/0380013 A1* 12/2015 Nongpiur ..... G10L 25/51 704/231

* cited by examiner

*Primary Examiner* — Curtis Odom
(74) *Attorney, Agent, or Firm* — Soroker Agmon Nordman

(57) ABSTRACT

A method of detecting animate presence in a vehicle, including, receiving an electronic signal from a motion sensor measuring vibrational motion of the vehicle, calculating a representation of the signal that differentiates between periodic motions which were combined to form the received signal, calculating a spectral density of the calculated representation, forming a decisive functional from the spectral density, comparing the decisive functional to a pre-determined threshold value to determine if there is animate presence in the vehicle.

20 Claims, 9 Drawing Sheets

AUTOMATIC SYSTEM AND METHOD FOR DETECTING PRESENCE OF PEOPLE OR ANIMALS IN A VEHICLE

TECHNICAL FIELD

The present invention relates to an automatic system and method for detecting the presence of people or animals in a vehicle.

BACKGROUND

There are many cases in which it is desirable to know if people and/or animals are present inside a vehicle. One such case is to prevent children, incapacitated people or animals from being forgotten inside a vehicle. Every year numerous cases occur where children, people or animals are forgotten in vehicles for extended periods. In warm climates this may lead to hospitalization due to dehydration or even to death.

Another type of case is at border checkpoints where vehicles are inspected to prevent unauthorized people from entering a protected area, crossing over from one state to another or to prevent smuggling animals or people into a state. Typically the unauthorized people may be intentionally hidden inside the vehicle to prevent them from being detected or they may have stowed away in the vehicle with the driver unaware of their presence.

Various systems have been suggested to detect the presence of people by placing seismic sensitive sensors (e.g. geophones) inside the vehicle (to prevent forgetting children) or in contact with the vehicle externally (e.g. at a checkpoint) to sense low level vibrations caused by the person's cardiorespiratory system. Typically the person's heart-beat, breathing, blood-flow and muscle reflections form vibrations having a frequency of between 1-20 Hz, which can be detected to identify the presence of a person in the vehicle. Typically a seismic sensor will measure motion/vibrations of the body of the vehicle relative to the ground via the tires, which serve as springs holding the mass of the vehicle. The seismic sensors provide an electrical signal that can be recorded and/or analyzed by a computer or electronic circuit to identify animate presence.

Standard analysis methods generally analyze the measured signal quantitatively without attempting to identify specific characteristics and potentially distinguishing features, which would indicate if the motion is due to an animate entity or to environmental factors (e.g. wind or rain). An example of such an analysis includes identifying zero crossings in the identified frequency range or summating motion energy based on the measured signal.

However one problem is that the measurements of the sensor are generally not taken in a sterile environment but rather are affected by the vibrations caused by environmental noise such as wind gusts, rain drops and other vehicles passing by. The environmental factors can lead to a high percentage of false identification of animate presence.

One solution to the problem of environmental interference is by using additional sensors to measure the ground vibrations next to the vehicle and/or vibrations in the air/environment surrounding the vehicle. By comparison of the measurements of the various sensors the environmental influence can be subtracted.

An alternative method that relies only on sensors measuring the vibrations of the vehicle attempts to enhance analysis of the signal by integrating the energy of the signal to determine its relative strength and comparing the results to a threshold value to determine if extra energy is available from the hidden person or animal. One problem with this method is that it takes a relatively long time (e.g. a few minutes) to collect a large enough sample to get reliable results and it still suffers from extra energy provided by external vibrations.

SUMMARY

An aspect of an embodiment of the disclosure relates to a system and method for detecting animate presence in a vehicle using motion sensors. The motion sensor provides an electronic signal based on the measurements of the motion sensor. The signal is provided to an electronic circuit having a processor and memory to analyze the signal and determine if there is animate presence in the vehicle (e.g. a person or a large animal such as a dog or cat). The electronic circuit optionally, removes any constant trend from the signal to form a centered signal. Then the electronic circuit calculates a representation that differentiates between the periodic motions which were combined to form the signal. In an exemplary embodiment of the disclosure, the representation is formed by calculating the cepstrum of the signal.

After forming the differentiating representation a spectral density is calculated from the representation and then a decisive functional is formed from the information of the spectral density. Optionally, the decisive functional is formed by multiplying three functionals that are calculated from the spectral density and represent average values of the vibrating vehicle system. One functional represents the energy distribution. A second functional represents the average rigidity of the vehicle (analogous to the spring constant of a vibrating spring). A third functional represents the average mass of the vibrating vehicle system.

The decisive functional is compared to a threshold constant to determine if it is represents a presence of a person or animal or if it represents the absence of animate presence. Optionally, the values of the decisive functional are affected by the weight of the vehicle. In some embodiments of the disclosure, the threshold constant is selected to fit all weights or alternatively, it is selected as a function of the weight of the vehicle being analyzed.

There is thus provided according to an exemplary embodiment of the disclosure, a method of detecting animate presence in a vehicle, comprising:

Receiving an electronic signal from a motion sensor measuring vibrational motion of the vehicle;

Calculating a representation of the signal that differentiates between periodic motions which were combined to form the received signal;

Calculating a spectral density of the calculated representation;

Forming a decisive functional from the spectral density;

Comparing the decisive functional to a pre-determined threshold value to determine if there is animate presence in the vehicle.

In an exemplary embodiment of the disclosure, calculation of the representation of the signal is performed by calculating a cepstrum of the signal. Optionally, the received signal is analyzed to detect a trend and remove it to form a centered signal before calculating the representation. In an exemplary embodiment of the disclosure, the received signal is split into multiple segments and each segment is processed to determine if there is animate presence in the vehicle. Optionally, the result is based on an average of the results for the multiple segments. In an exemplary embodiment of the disclosure, the decisive functional is the product of three functionals: one representing the energy near the maximum frequency of the spectral density, one representing the average rigidity of the vehicle; and one representing the average equivalent mass of the vehicle. Optionally, the decisive functional is larger when there is no animate presence in the vehicle than when there is animate presence in the vehicle. In an exemplary embodiment of the disclosure, the motion sensor is installed in the vehicle. Alternatively, the motion sensor is coupled to the vehicle externally when being checked. Optionally, the predetermined threshold is a function of the weight of the vehicle.

There is further provided according to an exemplary embodiment of the disclosure, a system for detecting animate presence in a vehicle, comprising: A motion sensor for measuring vibrations of the vehicle and providing an electronic signal representing the measured vibrations;

A processor and memory for analyzing the electronic signal; wherein said analyzing includes:

Receiving the electronic signal from the motion sensor measuring vibrational motion of the vehicle;

Calculating a representation of the signal that differentiates between periodic motions which were combined to form the received signal;

Calculating a spectral density of the calculated representation;

Forming a decisive functional from the spectral density;

Comparing the decisive functional to a pre-determined threshold value to determine if there is animate presence in the vehicle.

In an exemplary embodiment of the disclosure, calculation of the representation of the signal is performed by calculating a cepstrum of the signal. Optionally, the received signal is analyzed to detect a trend and remove it to form a centered signal before calculating the representation. In an exemplary embodiment of the disclosure, the received signal is split into multiple segments and each segment is processed to determine if there is animate presence in the vehicle. Optionally, the result is based on an average of the results for the multiple segments. In an exemplary embodiment of the disclosure, the decisive functional is the product of three functionals: one representing the energy near the maximum frequency of the spectral density, one representing the average rigidity of the vehicle; and one representing the average equivalent mass of the vehicle. Optionally, the decisive functional is larger when there is no animate presence in the vehicle than when there is animate presence in the vehicle. In an exemplary embodiment of the disclosure, the motion sensor is installed in the vehicle. Alternatively, the motion sensor is coupled to the vehicle externally when being checked. In an exemplary embodiment of the disclosure, the predetermined threshold is a function of the weight of the vehicle.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear. It should be noted that the elements or parts in the figures are not necessarily shown to scale such that each element or part may be larger or smaller than actually shown.

DETAILED DESCRIPTION

Figure 1:
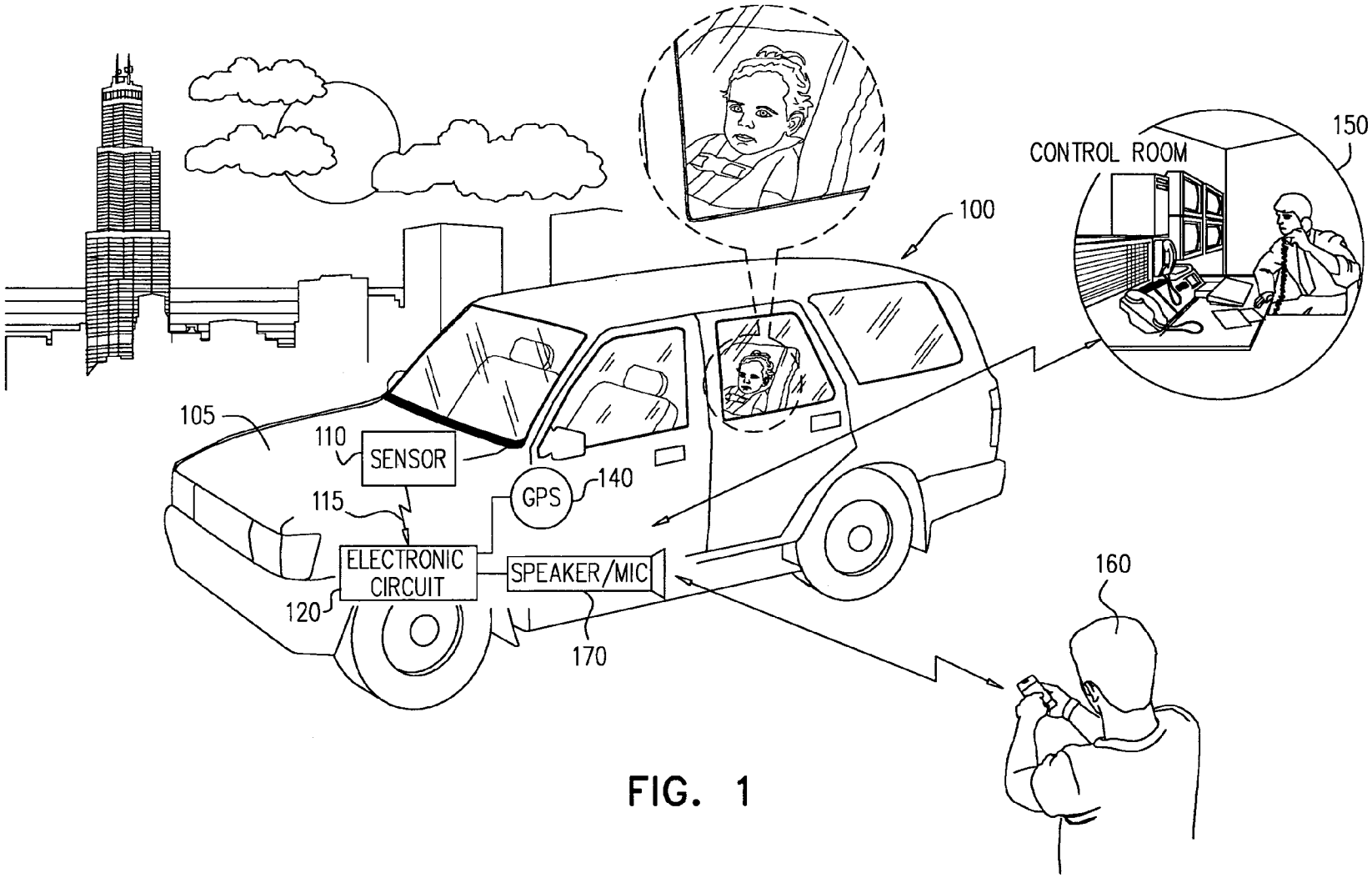
FIG. 1 is a schematic illustration of a preinstalled system for detecting animate presence in a vehicle, according to an exemplary embodiment of the disclosure.

In an exemplary embodiment of the disclosure, detection of the presence of people or animals in a vehicle 105 can be used to prevent them from being accidently forgotten in the vehicle. FIG. 1 is a schematic illustration of a preinstalled system 100 for detecting the presence of people in the vehicle 105, according to an exemplary embodiment of the disclosure. Optionally, system 100 includes one or more motion sensors 110 that are preinstalled inside the vehicle 105 or attached under the vehicle 105, for sensing the vibrations of the vehicle 105. The motion sensor 110 may be seismic sensors (e.g. geophones), accelerometers or other types of sensors. Optionally, the motion sensors 110 are coupled to the body of the vehicle 105, for example in the trunk of a car inside the vehicle or underneath the vehicle 105 near the tires/vibration damping springs (e.g. one sensor near each tire or near each back tire) to enhance sensitivity to motion of the mass of the vehicle 105 relative to the ground via the tires.

In an exemplary embodiment of the disclosure, the motion sensors 110 provide an electronic signal 115 representing the recorded motion. Optionally, the signal 115 may be an analog signal or a digital signal. In an exemplary embodiment of the disclosure, the signal 115 is provided to an electronic circuit 120. Optionally, electronic circuit 120 includes an analog to digital convertor to convert the signal into a digital signal for processing. Additionally, electronic circuit 120 may also include amplification elements and/or a lowpass filter to limit the range of the signal for processing (e.g. between 1-20 Hz). Further additionally, electronic circuit 120 includes a processor and memory to analyze the recorded motion.

In an exemplary embodiment of the disclosure, the processing by electronic circuit 120 will allow identification of the periodic motions that were combined to form the signal 115 so that the vibrations from animate presence may be identified. As known in Ballistocardiography the blood flow of a person or animal (e.g. dog or cat or larger animal) forms a repetitive motion arising from the repetitive ejection of blood into the blood vessels (e.g. large and small blood circulation circles) with each heartbeat. The blood flow forms a periodic vibration with a frequency between 1-20 Hz. Optionally, by identifying and analyzing the periodic motion by methods explained below it is sufficient to use measurements that were sampled for a time period of between 30-60 seconds or even 10-30 seconds. Other methods of analysis generally require larger signal samples and cannot provide results based on 60 seconds or less.

In an exemplary embodiment of the disclosure, electronic circuit 120 analyzes the signal 115 and determines if there is animate presence in the vehicle 105. Optionally, the determination is provided to an alarm 130 that is in charge of alerting the vehicle user 160 and/or a service center 150. Optionally a GPS 140 is included in system 100 to provide the coordinates of the vehicle 105 so that the vehicle 105 can be located without needing to contact the vehicle user 160. In an exemplary embodiment of the disclosure, system 110 is automatically activated by turning off the motor of the vehicle 105 and locking the vehicle 105. Alternatively or additionally, system 110 can be activated by the owner even if the motor is left on. In some embodiments of the disclosure, system 110 remains activated until deactivated by the vehicle user 160, for example to prevent unauthorized use of the vehicle 105. When system 110 is activated it may check the vehicle 105 periodically to determine if there is animate presence.

In an exemplary embodiment of the disclosure, if animate presence is detected in vehicle 105 alarm 130 communicates with service center 150 and/or user 160 to notify them. Optionally, service center 150 may provide a service of dispatching a person to check the vehicle 105 or it may form contact with the vehicle user 160 to notify them of the detection. In an exemplary embodiment of the disclosure, alarm 130 forms communication using a mobile telephone, RF wireless transceiver or other means.

In an exemplary embodiment of the disclosure, system 100 includes a speaker/microphone 170, to sound an audible alarm, for example to alert people in the vicinity or to alert a person in the vehicle 105. Optionally, speaker/microphone 170 can provide two way communications with people in the vehicle or in the vicinity of the vehicle 105.

Figure 2:
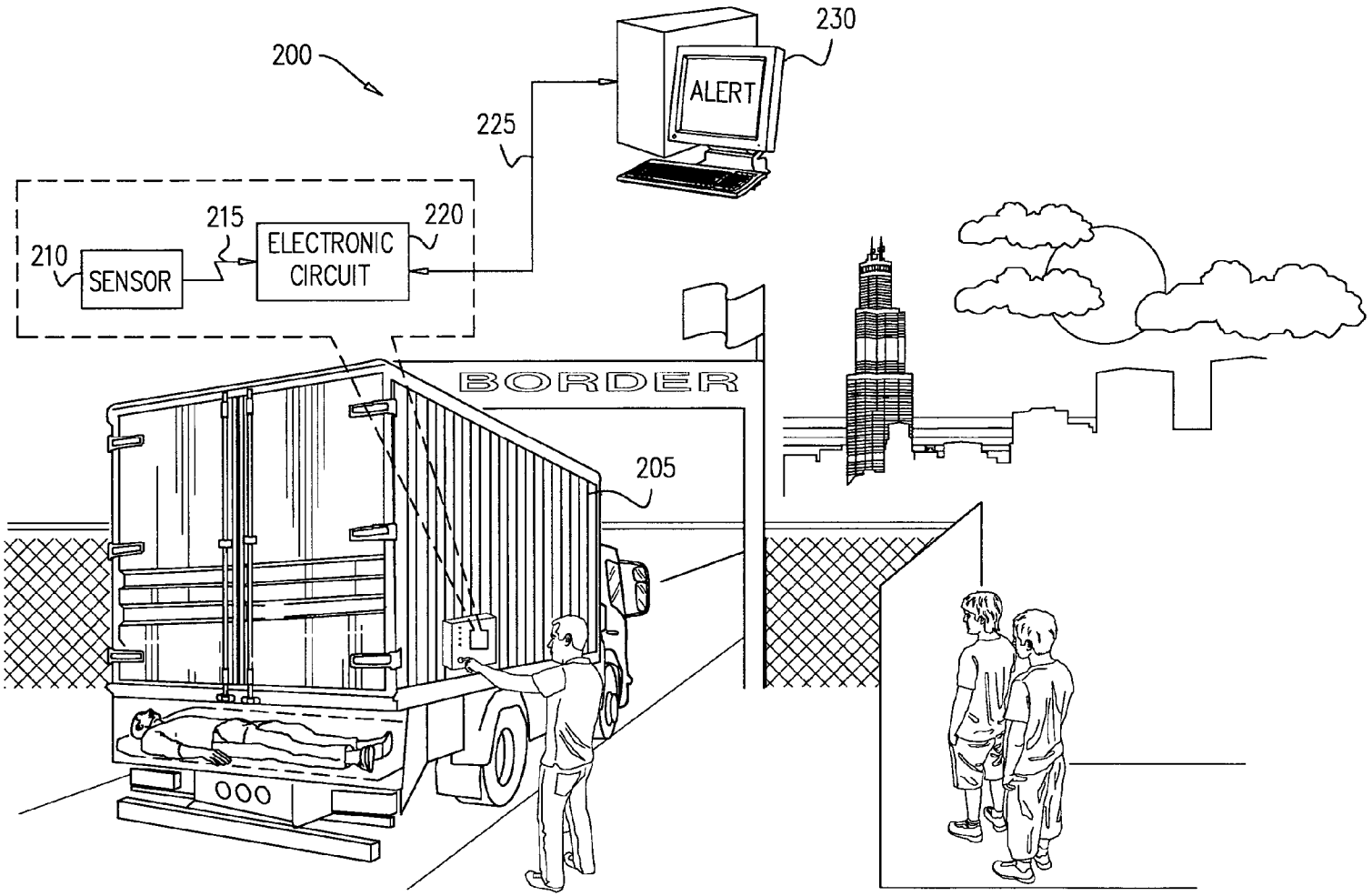
FIG. 2 is a schematic illustration of an alternative system for detecting animate presence in a vehicle, according to an exemplary embodiment of the disclosure.

FIG. 2 is a schematic illustration of an alternative system 200 for detecting animate presence in a vehicle 205, according to an exemplary embodiment of the disclosure. In an exemplary embodiment of the disclosure, system 200 is not preinstalled to a specific vehicle and is used for example at border checkpoints or roadblocks on any vehicle that passes through. Optionally, the driver and passengers are requested to exit the vehicle 205 and one or more sensors 210 are placed on the vehicle 205 to measure the vibrations of the vehicle 205, which is supposedly without people or animals inside. The sensors 210 may be attached to the vehicle 205 by magnets or held in place by the force of gravity. In an exemplary embodiment of the disclosure, the sensors 210 are coupled to an electronic circuit 220, similar to electronic circuit 120 for recording and analyzing a signal 215 representing the recorded motion. Optionally, electronic circuit 220 is connected by a cable 225 or wirelessly to a general purpose computer 230 for assisting in analyzing the recorded motion and/or displaying the results to a user of the system 200. Optionally, the user is provided with a notification on a display of the computer informing if animate presence was detected in the vehicle 205.

Figure 3:
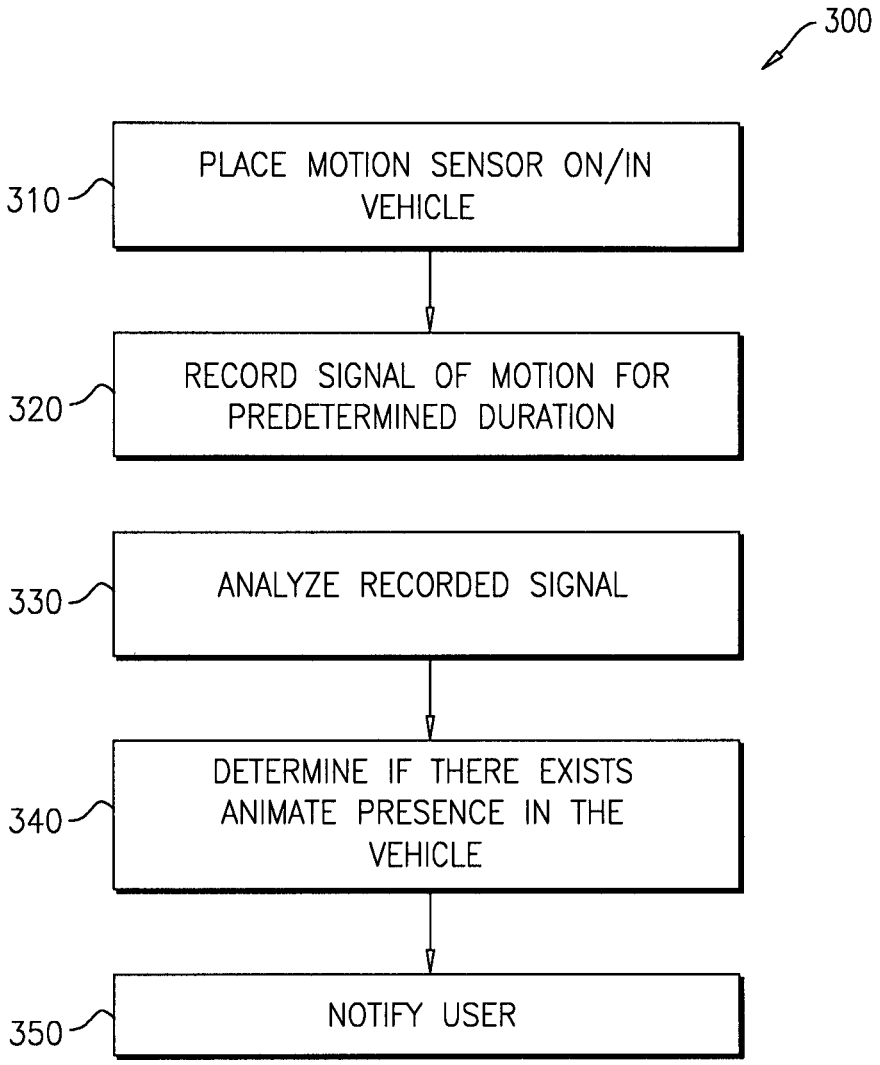
FIG. 3 is a flow diagram of a method of detecting animate presence in a vehicle, according to an exemplary embodiment of the disclosure.

FIG. 3 is a flow diagram 300 of a method of detecting animate presence in a vehicle, according to an exemplary embodiment of the disclosure. Optionally, one or more motion sensors are placed (310) on or in the vehicle. In some cases they may be preinstalled or they may be momentarily placed on the vehicle. In an exemplary embodiment of the disclosure, the motion sensors record motion (320) for a predetermined time duration and provide a recorded signal (115, 215) for analysis by a dedicated electronic circuit (120 or 220) or by a general purpose computer 230. Optionally, the time duration may be less than 60 seconds or even less than 30 seconds. In an exemplary embodiment of the disclosure, the user may be provided with an indication that enough data was recorded so that the motion sensors 210 may be removed.

In an exemplary embodiment of the disclosure, the signal (115, 215) is analyzed (330) by the electronic circuit (120, 220) or computer 230 to determine (340) if animate presence is detected. In some embodiments of the disclosure, the user only receives a notification (350) if animate presence is detected, for example with system 100. Alternatively, the user receives notification (350) of success or failure, for example in system 200 to determine if the vehicle should be searched or not.

Signal Analysis

Figure 4:
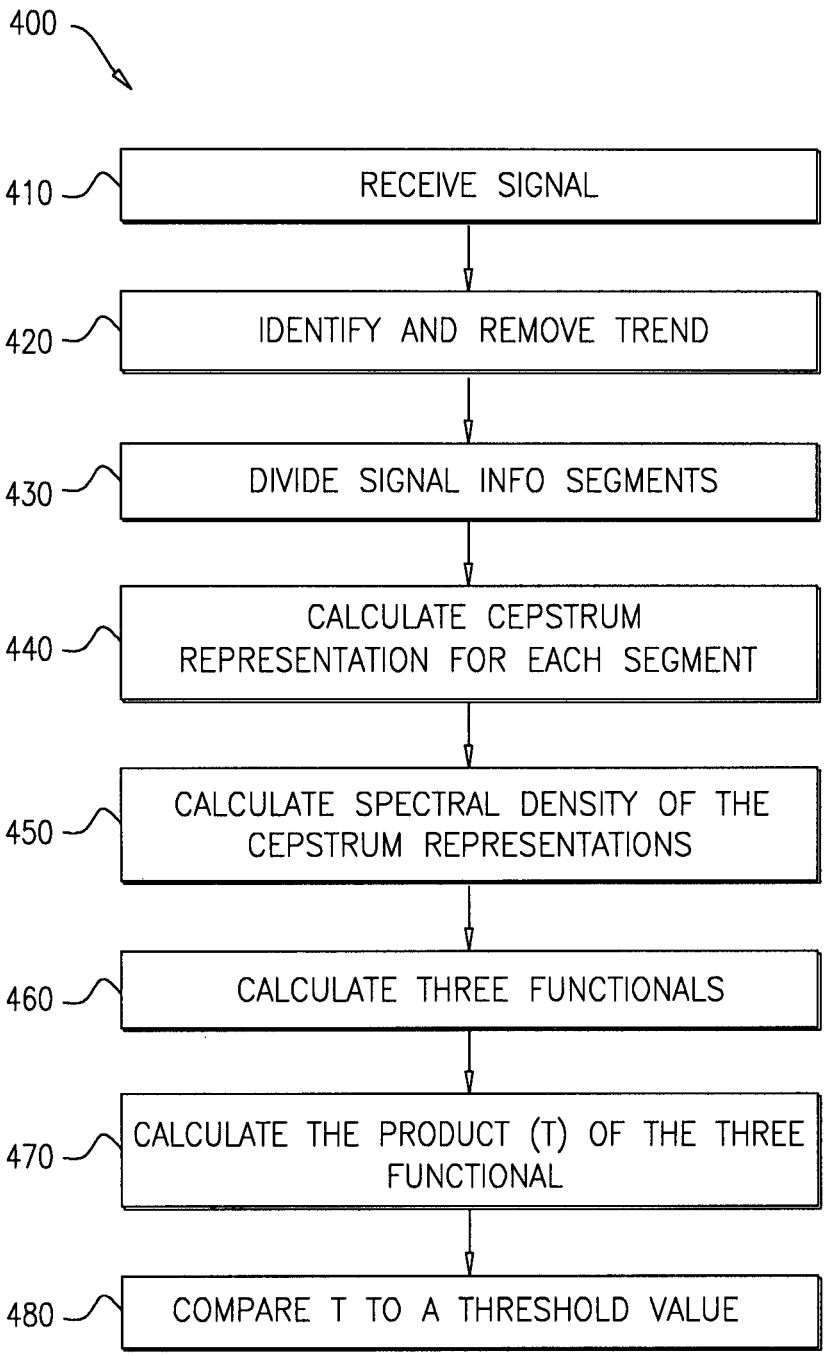
FIG. 4 is a flow diagram of a method of analyzing a signal, according to an exemplary embodiment of the disclosure.

FIG. 4 is a flow diagram of a method 400 of analyzing a signal (115, 215), according to an exemplary embodiment of the disclosure. In an exemplary embodiment of the disclosure, the signal (115 or 215) is received (410) by electronic circuit (120, 220) or computer 230 for analysis. Optionally, the circuit may be off center so the signal is first analyzed to identify (420) a trend (e.g. a constant DC component of the signal). Optionally, the trend is removed (420) from the signal to simplify calculations by forming a centered signal (e.g. centered around the zero of a coordinate system).

In an exemplary embodiment of the disclosure, the signal is divided into multiple non overlapping segments, for example segments of 100 ms-1000 ms intervals. Optionally, the signal (e.g. of 30-120 seconds) is divided into n segments (e.g. 50-1000 segments, for each segment: $t \in (mA,(m+1)\Delta)$ where: $\Delta$ is the selected time interval, $m=0, 1, \ldots, n-1$; and n is the total number of the time intervals equal/segments.

In an exemplary embodiment of the disclosure, a cepstrum representation is calculated (440) for each segment. The cepstrum representation is the inverse Fourier transformation of the logarithm of a spectrum signal. It is therefore the inverse spectrum of a non-linear spectrum transformation, and has properties that are useful in analysis of certain signals. Optionally, periodicities or repeated patterns in a spectrum will be sensed as one or two components in a spectral density of a cepstrum. If a spectrum contains several sets of sidebands or harmonic series, they can be confused in the spectrum because of overlap. However in the cepstrum, they are separated in a way similar to the way the spectrum separates repetitive time patterns in a waveform. In an exemplary embodiment of the disclosure, the cepstrum enables differentiation between the periodic ballistocardiograph motion (which is highly periodic, with a period of between 1-20 Hz (e.g. about 4-8 Hz for a male human)) and the other signals that exist in the vehicle.

In an exemplary embodiment of the disclosure, a spectral density is calculated (450) from the cepstrum representation. Optionally, the spectral density is then used to calculate (460) three functionals. In an exemplary embodiment of the disclosure, the periodic motion can be regarded as analogous to simple periodic motion of a pendulum (or charge oscillations in an electrical LC circuit) for which we can calculate three functionals representing three basic values of the periodic motion:

T1—the level of energy concentration in the vicinity of the frequency, with the maximum value (the main frequency) in the central zone which is limited to a level at 0.5 of the maximum value of the spectral density from the cepstrum (analogous to the kinetic energy of the moving mass or the energy of the electric field in an oscillating circuit);

T2—the average equivalent rigidity of the inspected object model (e.g. analogous to the spring constant in a vibrating spring or reciprocal of capacitance in the electrical circuit);

T3—the average equivalent mass of the inspected object (or inductance in an LC circuit).

The three functionals are related to each other so that their product is essentially constant or forms a tight cluster when shown graphically as in FIGS. 5A to 5D.

In an exemplary embodiment of the disclosure, the product of the three functionals is calculated (470) as:

$$T=T1\times T2\times T3$$

The product provides a decisive functional T for comparing (480) with a threshold value to determine if there is animate presence in the vehicle.

In an exemplary embodiment of the disclosure, T1 (energy based on the results of the spectral density of the Cepstrum) is defined as follows:

$$M=\{\max f(\omega),\ \omega\epsilon[\omega 0,\omega 1]\}.$$

where:

ω—is the frequency in the spectrum of the received signal

ω0—is the upper possible limit of external frequencies

ω1—is the lower possible limit of the natural transport vehicle frequencies (e.g. ω=0, ω1=20 Hz)

max $f(\omega)$, $\omega\epsilon(a, b)$

We define the maximum value of the function $f(\omega)$ in the [a, b] interval min $f(\omega)$, $\omega\epsilon(a,b)$ We define the minimum value of the function $f(\omega)$ in the [a, b] interval We define the frequency values on the side of the lower values at the level of the maximum middle of the spectral density from the Cepstrum as $$\omega_-=\min\{\omega,\ f(\omega)=M/2\},$$

and define the frequency values on the side of the higher values at the level of the maximum middle of the spectral density from the Cepstrum as $$\omega_+=\max\{f(\omega)=M/2\}$$

Functional T1 is calculated by:

$$T1=\int_{\omega_-}^{\omega_+} f(\omega)d\omega/\int_{\omega 0}^{\omega 1} f(\omega)d\omega\approx\Sigma_{\omega_i\epsilon(\omega_-,\omega_+)} f(\omega_i)/\Sigma_{\omega_i\epsilon(\omega 0,\omega 1)} f(\omega_i),$$

where $f(\omega)$—is the spectral density from the Cepstrum signal, $\omega_i$—is sequence of frequencies used in the concerned range (in the case proposed for solving $\omega_-<\omega_i<\omega_+$ Hz in the numerator, $\omega_i\epsilon(\omega 0,\omega 1)$ Hz in denominator, practically $1<\omega_i<\max\omega$.

In an exemplary embodiment of the disclosure, T2 (average equivalent rigidity—analogous to a constant of motion of the pendulum) is defined as follows:

$$T2=\int_{\omega 0}^{\omega 1}\omega f(\omega)d\omega\approx h\Sigma_{\omega_i\epsilon(\omega 0,\omega 1)}\omega_i f(\omega_i),$$

where: $f(\omega)$, as explained above, is the spectral density from the Cepstrum of the initial signal, $\omega_i$—as defined above, h—is the integration step (e.g. h=1).

In an exemplary embodiment of the disclosure, T3 (average equivalent mass—analogous to the mass of the equivalent pendulum) is defined as follows:

$$T3=1/\int_{\omega 0}^{\omega 1}(f(\omega)/\omega)d\omega\approx 1/h\Sigma_{\omega_i\epsilon(\omega 0,\omega 1)} f(\omega_i)/\omega_i.$$

Optionally, when animate presence exits in the vehicle (let us call this condition S1), value T1 is considerably higher than in the case of absence of a person or animal (condition S0), i.e. $Tk_{S0}<Tk_{S1}$.

($Tk_{S0}$, $Tk_{S1}$ in this case designate the value of k-functionals calculated for condition S0 (S1), k=1, 2, 3.).

After calculating the three functionals (T1, T2, T3) for a segment The decisive functional T is calculated (480) as the product of functionals T1, T2 and T3 which were already calculated, i.e. $T_{S0}$ represents the value of function T when it is calculated for state S0, and $T_{S1}$ represents the value of the same function when it is calculated for state S1, i.e. for a state when there is no animate presence in the vehicle.

In an exemplary embodiment of the disclosure, it was found that $$T_{S1}<T_{S0},$$

FIGS. 5A to 5D show a graph with a cluster of calculated decisive functionals T for multiple segments. Wherein in part I the decisive functionals were calculated when there is no animate presence and in part II the decisive functionals were calculated when there was animate presence.

In an exemplary embodiment of the disclosure, each axis of the coordinate system represents one of the functionals T1, T2, T3 and the plotted point represents the product of the three functionals.

Figure 5A:
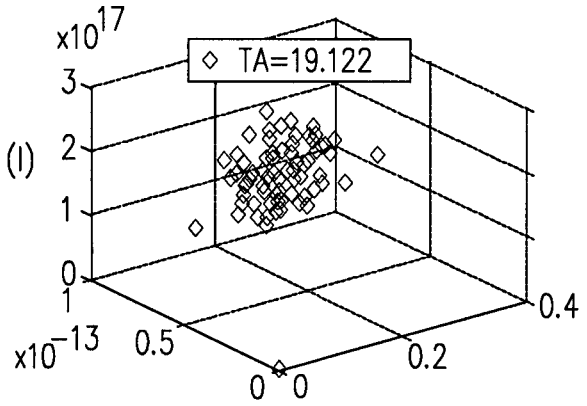
FIG. 5A-5D are graphs of a cluster of calculated decisive functionals for multiple segments when there is no animate presence and when there is animate presence in the vehicle, according to an exemplary embodiment of the disclosure.
Figure 5A:
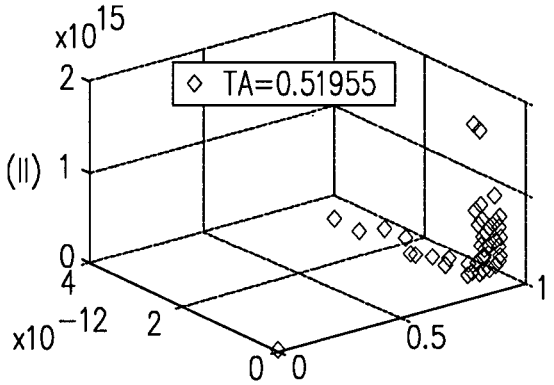
Figure 5B:
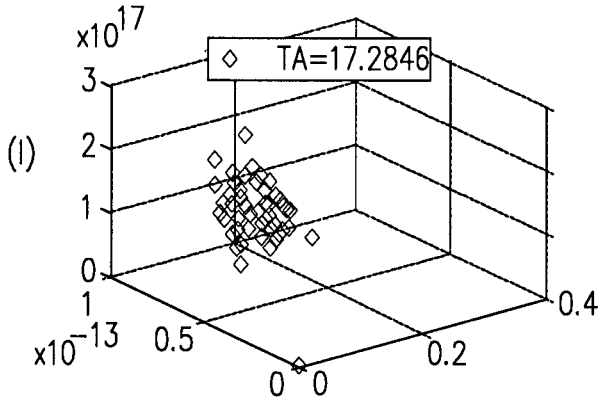
Figure 5B:
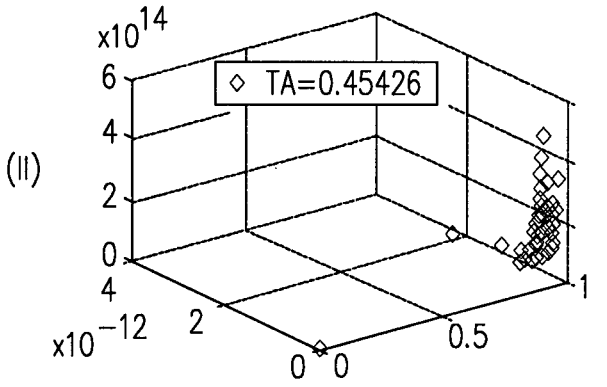
Figure 5C:
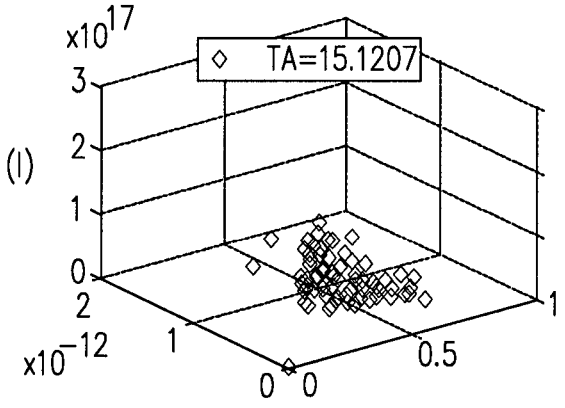
Figure 5C:
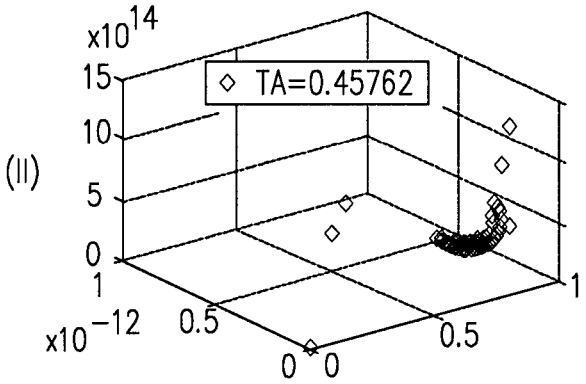
Figure 5D:
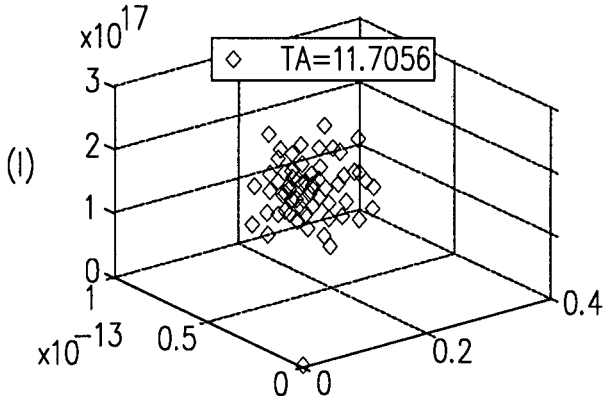
Figure 5D:
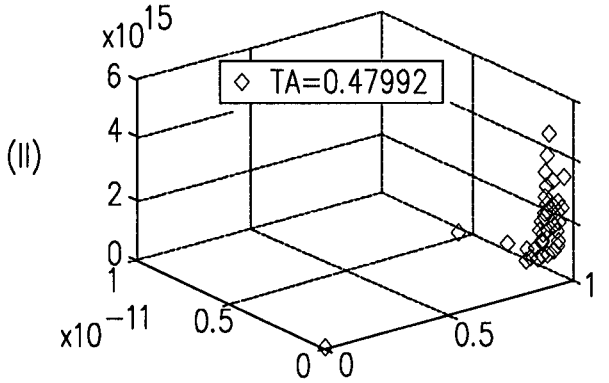

In FIG. 5A the calculations were made for a Daihatsu car having a weight of about 1450 Kg;

In FIG. 5B the calculations were made for a Honda car having a weight of about 1705 Kg;

In FIG. 5C the calculations were made for a Buick car having a weight of about 2425 Kg;

In FIG. 5D the calculations were made for a Volkswagen car having a weight of about 2860 Kg.

As provided in FIGS. 5A to 5D an average decisive functional value TA (for all the segments) is calculated from the cluster of calculated decisive functionals (T) for each graph.

Figure 6:
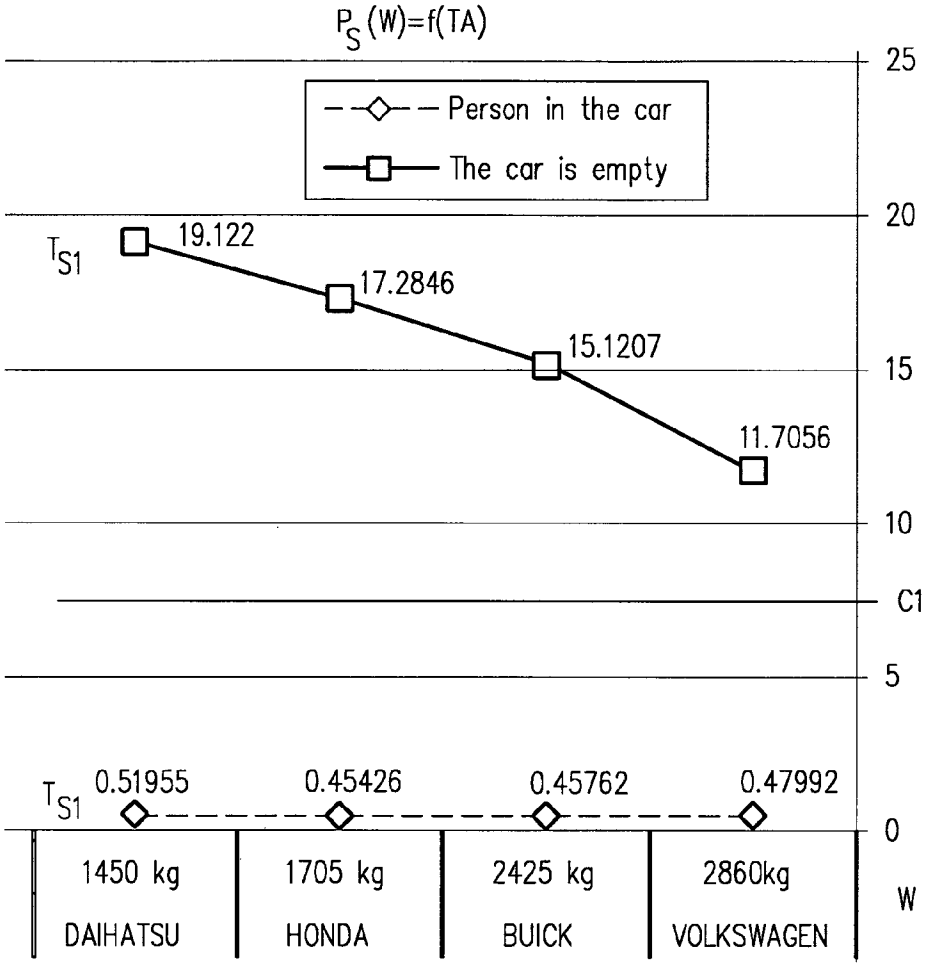
FIG. 6 is a graph of an average decisive functional as a function of the weight of the vehicle when there is no animate presence and when there is animate presence in the vehicle, according to an exemplary embodiment of the disclosure.

FIG. 6 shows the average decisive functional values TA as a function of the weight of the vehicle. Optionally, as shown in FIG. 6 $T_{S1}$ (No animate presence) is at least five or ten times larger than $T_{S0}$ (with animate presence). Optionally, repeating the calculations n times (for n segments) increases the accuracy of the result. In an exemplary embodiment of the disclosure, instead of providing a response in one second, a more accurate response is provided in n seconds, for example 60 seconds. However it should be noted that a determination is made from an essentially short period (one segment) since the analysis is based on identifying the original periods of motion forming the analyzed signal (115, 215).

In an exemplary embodiment of the disclosure, a value C1 is defined as the threshold constant. The presence or absence of a person or animal in the vehicle is defined based on the analysis the average decisive functional TA of the cluster of T values relative to the threshold constant C1. Optionally, when TA<C1 there is animate presence in the vehicle and if TA>C1—there is no animate presence in the vehicle).

In an exemplary embodiment of the disclosure, the threshold constant C1 is defined empirically. Optionally, the threshold value is calculated based on tests in various states for different types of vehicles and sensors. In some embodiments of the disclosure, the threshold constant C1 is a function of the weight/mass of the vehicle being examined, for example C1=f(W).

In an exemplary embodiment of the disclosure, the threshold constant C1 is calculated by the following process:

We shall define the average value TA of the calculated decisive functionals T as a0 for the calculation in which there is no one in the vehicle of the given type, and its corresponding standard deviation as Σ0; The average value of the calculated functionals of T for the state in which there is a person in the vehicle as a1; and its corresponding standard deviation as Σ1 and then it is possible to define C1 as:

$$C1=(a0\cdot\Sigma1+a1\cdot\Sigma0)/(\Sigma0+\Sigma1).$$

As explained above the calculation of the decisive functional T is performed for n equal time intervals that do not overlap (e.g. one second or two seconds (scanning intervals) during the selected period, e.g. one minute).

Accordingly, the decisive function is defined as:

$$\Sigma T=\Sigma_{m=1}{}^{n}T_m$$

Where $T_m$—is the value of the T functionals received according to the sensor's signal within time t∈mΔt, (m+1)Δt, m=0, 1, . . . , n−1.

In an exemplary embodiment of the disclosure, the value of ΣT is compared to a threshold constant C2=nC1, where n is the number of segments/control calculations. Alternatively, C1 may be compared to TA that is the average decisive functional (e.g. ΣT/n). The use of multiple segments provides a more reliable result than for a single calculation that may fluctuate.

According to the proposed method, a clear conclusion regarding the presence or absence of a person or animal in the vehicle or a container installed on the vehicle is received resulting from the performance of the method in a single dimension space of identification according to the average product of the functionals T1, T2 and T3 (see FIG. 6), or in a three dimensional space of identification—according to the position of the physical group of points (see FIGS. 5A-5D), wherein each one of the points represents a decisive functional $T_m$ based on the functionals T1, T2 and T3 at a specific time segment. Optionally, by identifying the most dense concentration in the defined volume of the identification of these points. Optionally, a separating plane can be used graphically to differentiate between state S0 (no animate presence) and state S1 (animate presence exits).

In an exemplary embodiment of the disclosure, the data depicted in FIG. 6 can be processed using the least squares reduction method, according to the following dependence:

$$P_s(W)=T_s(W)=a_{0,1}+b_{0,1}*W+c_{0,1}*W^2+d_{0,1}*W^3,$$

where $T_s(W)$ equals the values of the decisive functional reached according to conditions S1, S0 accordingly, and W is the weight of the transport vehicle.

In an exemplary embodiment of the disclosure, the following values were determined empirically for vehicles with a weight between 1 to 7 tons using a specific motion sensor (110, 210):

For S0: $a_0$=32.0422; $b_0$=−11.7767; $c_0$=1.9867; $d_0$=−0.113;
For S1: $a_1$=0.5652; $b_1$=−0.0257; $c_1$=−9.3505e-04; $d_1$=3.3777e-04;

In some embodiments of the disclosure, an average of the empirical constants can be used, wherein:

$$a=(a_0+a_1)/2=16.3037, \quad (1)$$

$$b=(b_0+b_1)/2=-5.9012; \quad (2)$$

$$c=(c_o+c_1)/2=0.9929, \quad (3)$$

$$d=(d_0+d_1)/2=-0.0563; \quad (4)$$

Optionally, an algorithm of recognition can be used, based on (1)-(4). Precisely, with W representing the transport vehicle weight, then in case $P>P_s$ (W) [equivalent to the inequality T>C1], the conclusion is taken according to the absence of a person in the transport vehicle. And in case $P<P_s$ (W) [equivalent to the inequality T<C1], the conclusion is taken according to the presence of a person in the transport vehicle.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure. It will also be appreciated by persons skilled in the art that the present disclosure is not limited to what has been particularly shown and described hereinabove.

We claim:

1. A method of detecting animate presence in a vehicle, comprising:

receiving an electronic signal from a motion sensor measuring vibrational motion of the vehicle;

calculating a representation of the signal that differentiates between periodic motions which were combined to form the received signal;

calculating a spectral density of the calculated representation;

forming a decisive functional from the spectral density;

comparing the decisive functional to a pre-determined threshold value to determine if there is animate presence in the vehicle.

2. A method according to claim 1, wherein calculation of the representation of the signal is performed by calculating a cepstrum of the signal.

3. A method according to claim 1, wherein the received signal is analyzed to detect a trend and remove it to form a centered signal before calculating the representation.

4. A method according to claim 1, wherein the received signal is split into multiple segments and each segment is processed to determine if there is animate presence in the vehicle.

5. A method according to claim 4, wherein the result is based on an average of the results for the multiple segments.

6. A method according to claim 1, wherein the decisive functional is the product of three functionals: one representing the energy near the maximum frequency of the spectral density, one representing the average rigidity of the vehicle; and one representing the average equivalent mass of the vehicle.

7. A method according to claim 1, wherein the decisive functional is larger when there is no animate presence in the vehicle than when there is animate presence in the vehicle.

8. A method according to claim 1, wherein the motion sensor is installed in the vehicle.

9. A method according to claim 1, wherein the motion sensor is coupled to the vehicle externally when being checked.

10. A method according to claim 1, wherein the predetermined threshold is a function of the weight of the vehicle.

11. A system for detecting animate presence in a vehicle, comprising:

a motion sensor for measuring vibrations of the vehicle and providing an electronic signal representing the measured vibrations;

a processor and memory for analyzing the electronic signal; wherein said analyzing includes:

receiving the electronic signal from the motion sensor measuring vibrational motion of the vehicle;

calculating a representation of the signal that differentiates between periodic motions which were combined to form the received signal;

calculating a spectral density of the calculated representation;

forming a decisive functional from the spectral density;

comparing the decisive functional to a pre-determined threshold value to determine if there is animate presence in the vehicle.

12. A system according to claim 11, wherein calculation of the representation of the signal is performed by calculating a cepstrum of the signal.

13. A system according to claim 11, wherein the received signal is analyzed to detect a trend and remove it to form a centered signal before calculating the representation.

14. A system according to claim 11, wherein the received signal is split into multiple segments and each segment is processed to determine if there is animate presence in the vehicle.

15. A system according to claim 14, wherein the result is based on an average of the results for the multiple segments.

16. A system according to claim 11, wherein the decisive functional is the product of three functionals: one representing the energy near the maximum frequency of the spectral density, one representing the average rigidity of the vehicle; and one representing the average equivalent mass of the vehicle.

17. A system according to claim 11, wherein the decisive functional is larger when there is no animate presence in the vehicle than when there is animate presence in the vehicle.

18. A system according to claim 11, wherein the motion sensor is installed in the vehicle.

19. A system according to claim 11, wherein the motion sensor is coupled to the vehicle externally when being checked.

20. A system according to claim 11, wherein the predetermined threshold is a function of the weight of the vehicle.

* * * * *